US006938873B2

(12) United States Patent
Fischer

(10) Patent No.: US 6,938,873 B2
(45) Date of Patent: Sep. 6, 2005

(54) COMPOUND VALVE ASSEMBLY FOR CONTROLLING HIGH AND LOW OIL FLOW AND PRESSURE

(75) Inventor: Thomas H. Fischer, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/724,664

(22) Filed: Dec. 1, 2003

(65) Prior Publication Data

US 2005/0116189 A1 Jun. 2, 2005

(51) Int. Cl.[7] ..... F02M 39/00
(52) U.S. Cl. ..... 251/30.04; 251/30.01
(58) Field of Search ..... 251/30.01–30.04

(56) References Cited

U.S. PATENT DOCUMENTS 3,844,528 A * 10/1974 Massie ..... 251/30.04
4,727,830 A 3/1988 Nagahiro et al.
4,753,212 A * 6/1988 Miyaki et al. ..... 123/506
4,779,837 A * 10/1988 Mito et al. ..... 251/26
5,666,915 A 9/1997 Kawashima et al.
5,741,002 A * 4/1998 Breyer ..... 251/30.04
5,832,891 A 11/1998 Paul
5,887,847 A * 3/1999 Holborow ..... 251/33
2003/0200947 A1 10/2003 Harris

FOREIGN PATENT DOCUMENTS

EP 0353988 2/1990
WO 9808015 2/1998

* cited by examiner

*Primary Examiner*—J. Casimer Jacyna
(74) *Attorney, Agent, or Firm*—Jimmy L. Funke

(57) ABSTRACT

A compound valve assembly for controlling oil flow includes a first and a second valve. The first valve is a pressure relief valve including a spring-biased plunger in a side gallery opening off a primary oil supply gallery leading to a pressure-actuated device. The relief spring allows oil above a predetermined pressure to displace the plunger and to be returned to an oil sump. The side gallery is closable by a secondary valve seat and a solenoid-actuated valve head. A passage through the plunger leads to the second valve seat. When the solenoid is deactivated, oil flows through the passage, through the second valve, and is returned to the sump. When high pressure is desired at the device, the solenoid closes the second valve. Captive oil assumes the same pressure as the supply pressure, and the relief valve function is disabled, causing high pressure oil to flow to the device.

7 Claims, 2 Drawing Sheets

COMPOUND VALVE ASSEMBLY FOR CONTROLLING HIGH AND LOW OIL FLOW AND PRESSURE

TECHNICAL FIELD

The present invention relates to internal combustion engines; more particularly, to valves for controlling the flow of oil to oil-activated engine components such as variable valve actuators and camshaft phasers; and most particularly, to a compound valve for controlling oil flow alternatively at a high pressure for element activation and at a low pressure for element deactivation.

BACKGROUND OF THE INVENTION

It is known that for a portion of the duty cycle of a typical multiple-cylinder internal combustion engine, the load can be met by a functionally smaller engine having fewer firing cylinders, and that at low-demand times fuel efficiency can be improved if one or more cylinders of a larger engine can be withdrawn from firing service. It is known in the art to accomplish this by de-activating a portion of the valve train associated with pre-selected cylinders in any of various ways. For example, a special cam finger follower having a latching pin or slide which may be actuated and/or deactuated hydraulically. The cam finger follower is so configured that it causes low or no lift of the valve when the pin is disengaged and high lift of the valve when the pin is engaged.

Various methods and apparatus for actuating this type of latching pin or slide are known. For example, U.S. patent application Publication No. U.S. 2003/0200947 A1 discloses a hydraulic apparatus and return spring for latching and delatching a latching pin of a deactivating roller finger follower. The latching pin is disposed in, and extends from, a bore in an outer finger arm which is supported by a hydraulic lash adjuster. When moved inwards of the outer finger arm, the pin engages a central slider member which follows the surface of a camshaft lobe. When valve deactivation is desired, engine oil pressure supplied to the apparatus is increased to a level sufficient to overcome the force of the return spring and move the latching pin out of engagement with the slider member. The slider member continues to follow the surface of the camshaft, but the cam motion is not translated to the outer finger arm, and the valve is not actuated thereby.

For another example, a special hydraulic valve lifter having radially-operative latching pins also may be actuated or deactuated hydraulically. When the lifter is deactuated by high-pressure oil overcoming a latching spring, a pushrod seat is disengaged to deactivate the associated engine valve, while the cam-follower portion continues to follow the cam lobe in lost motion.

In providing such actuation mechanisms, it can be advantageous to provide ordinary engine oil as the pressurized actuating medium, supplied conventionally from the main engine oil pump via a standard engine oil gallery with minimal special oil porting. Further, it is advantageous to be able to throttle the flow of oil between high-flow/high-pressure and low flow/low-pressure without ever completely shutting off the flow of oil, as is the case in prior art on/off solenoid-actuated spool valves.

It is a principal object of the present invention to controllably vary the flow of pressurized oil between a high-flow/high-pressure condition and a low flow/low-pressure condition.

It is a further object of the invention to provide such control electromechanically via a simple solenoid valve.

SUMMARY OF THE INVENTION

Briefly described, a compound valve assembly for controlling high and low oil flow and pressure in accordance with the invention includes a first valve and a second valve. The first valve serves as a pressure relief valve which, in the example shown, includes a spring-biased cup-shaped plunger disposed in a side gallery opening off a primary oil supply gallery leading to or from a device to be oil-actuated. The plunger is seated in a first valve seat, and the relief spring is sized such that the plunger is displaced conventionally from the first valve seat at a predetermined upper limit of oil pressure to allow some oil to flow past the plunger and to be returned to the oil sump. The side gallery is closable at its opposite end by a secondary valve seat and a solenoid-actuated/spring-returned valve head. A small passage through the plunger end leads to the second valve seat, whereby a chamber within the plunger is filled with oil. When the solenoid is deactivated, oil also flows through the passage, through the second valve, and is returned to the sump. Thus, the flow and pressure of oil-flowing through the primary oil gallery to the control device are both low because much of the supplied oil bypasses the control device. When high oil flow and pressure are desired at the control device, the solenoid is energized, closing the second valve and capturing oil within the plunger. Because of communication through the plunger passage, the captive oil assumes the same pressure as the supply pressure in the primary gallery, and the relief valve function is disabled. Thus the flow and pressure of oil flowing through the primary gallery to the control device are both high. To deactuate the valve assembly, the solenoid is de-energized, reopening the second valve and again permitting oil pressure relief around and through the plunger.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
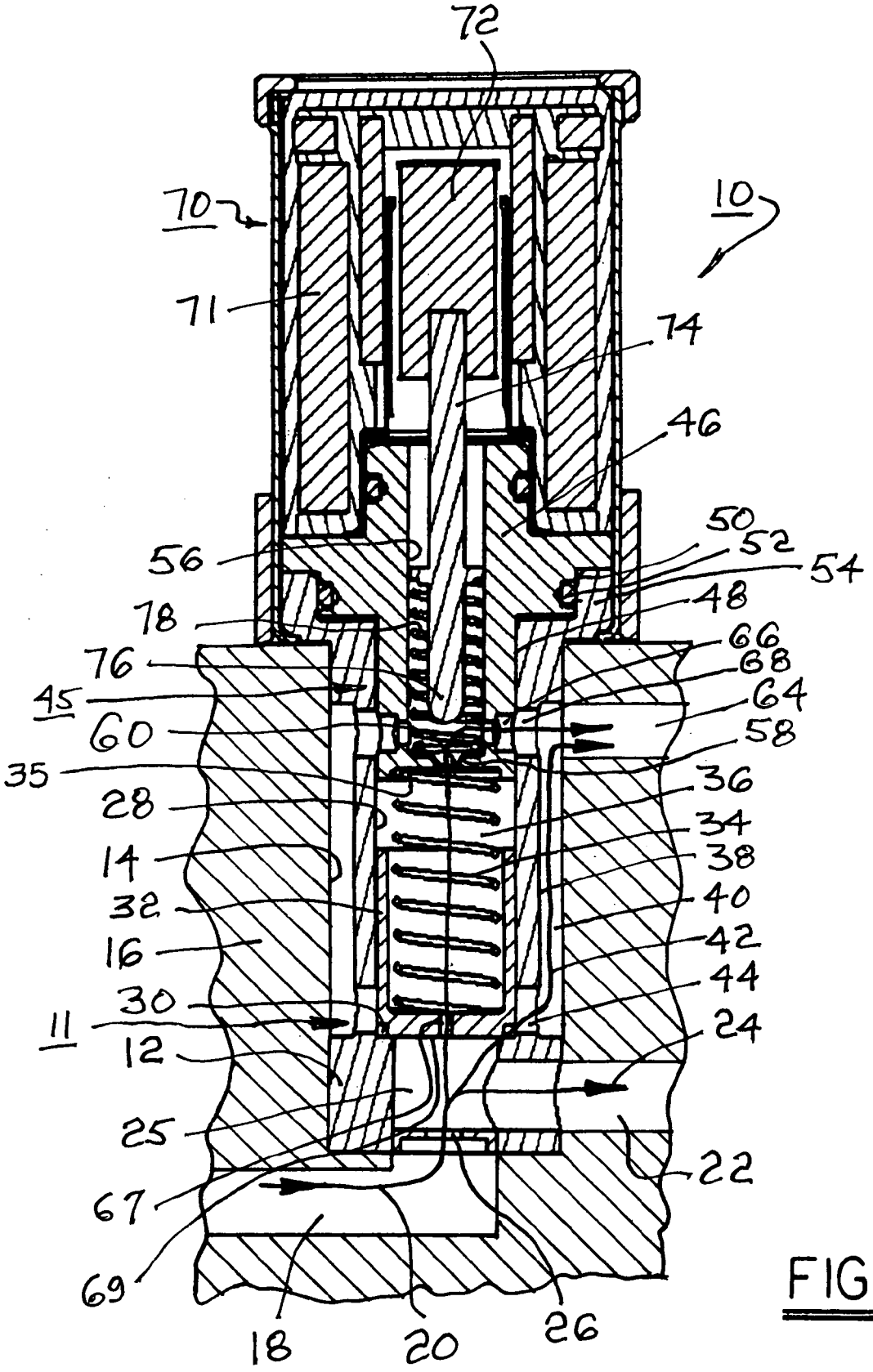
FIG. 1 is a elevational cross-sectional view of a compound valve assembly in accordance with the invention disposed for use in an internal combustion engine, the valve assembly being shown in deactuation mode for providing low oil flow and pressure to a control device of the engine.

Referring to FIG. 1, a compound valve assembly 10 in accordance with the invention comprises a first valve 11 including body 12, the body being generally cylindrical and adapted to be fitted into a first well 14 formed in an internal combustion engine 16. Well 14 intersects an oil supply gallery 18 wherein high pressure oil 20 is supplied as from an engine main oil pump (not shown). Well 14 further intersects a control gallery 22 leading to a device (not shown), such as for example, a deactivatable roller finger follower or hydraulic valve lifter, to be controlled by variable oil flow and pressure 24 as provided by assembly 10.

First valve body 12 includes a first chamber 25 open to supply gallery 18 and control gallery 22. Valve body 12 may include a flow-restricting orifice 26 sized for the maximum flow rate desired. Orifice 26 reduces the parasitic flow from the pressure relief feature of the valve assembly and allows a higher pressure to be retained in parallel galleries from a common supply pump.

First valve body 12 includes a second well 28 terminating in communication with first chamber 25 and defining an annular first valve seat 30 therebetween. A cup-shaped relief valve plunger 32 is disposed in second well 28 and is urged against first valve seat 30 by a compression spring 34 disposed within a second chamber 36 within relief valve plunger 32. A reduced-diameter portion 38 of first valve body 12 defines an annular space 40 between portion 38 and first well 14 of engine 16. Parasitic oil flow 42 being relieved by oil pressure displacement of relief valve plunger 32 from first valve seat 30 flows through radial port 44 into annular space 40.

A second valve 45 includes a second valve body 46 having a first diameter portion 48 that is close-fitted into second well 28 in first valve body 12 and a second diameter portion 50 that is sealed as by an O-ring 52 against flange 54 of first body 12. Second valve body 46 includes a third well 56 concentric with first and second wells 14,28, terminating in a second valve seat 58 surrounding a passage 60 between second chamber 36 and third chamber 62 in second valve body 46. Second valve body 46 further defines a spring seat 35 (FIG. 2) for relief spring 34. An oil sump-return gallery 64 in engine 16 communicates with annular space 40 and also with passage 60 via radial port 66 in second valve body 46 and radial port 68 in first body 12.

A solenoid actuator 70 having windings 71 is concentrically mounted onto second valve body 46 and includes a slidable armature 72 supportive of a secondary valve pintle 74 and valve head 76 for variably mating with second valve seat 58. A return spring 78 holds the secondary pintle valve 74 in the open position when the solenoid is de-energized.

A passage 67 is provided through the end 69 of plunger 32, permitting oil from first chamber 25 to enter second chamber 36 within relief valve plunger 32 and to flow through the secondary valve when open and return to the engine sump via port 64.

In operation in low-flow/low-pressure mode, as shown in FIG. 1, solenoid actuator 70 is de-energized. High pressure oil 20 at engine supply pressure flows through supply gallery 18, enters first chamber 25 via preferred restriction orifice 26 at a reduced flow and pressure, and exits first chamber 25 via control gallery 22. Relief spring 34 is sized to permit pressure relief of oil by displacing relief valve plunger 32 at a predetermined relatively low pressure level, oil flowing past plunger 32 and to sump return gallery 64 via annular space 40. In addition, excess oil flows through passage 67, filling second chamber 36 and flowing to sump return gallery 64 via passage 60 and second valve seat 58. The secondary pintle valve 74 is held open by spring 78.

It is an important aspect of the present invention that oil flow through control gallery 22 is never shut off, as it is in prior art spool valves, and always flows at some predetermined minimum flow rate and pressure.

Figure 2:
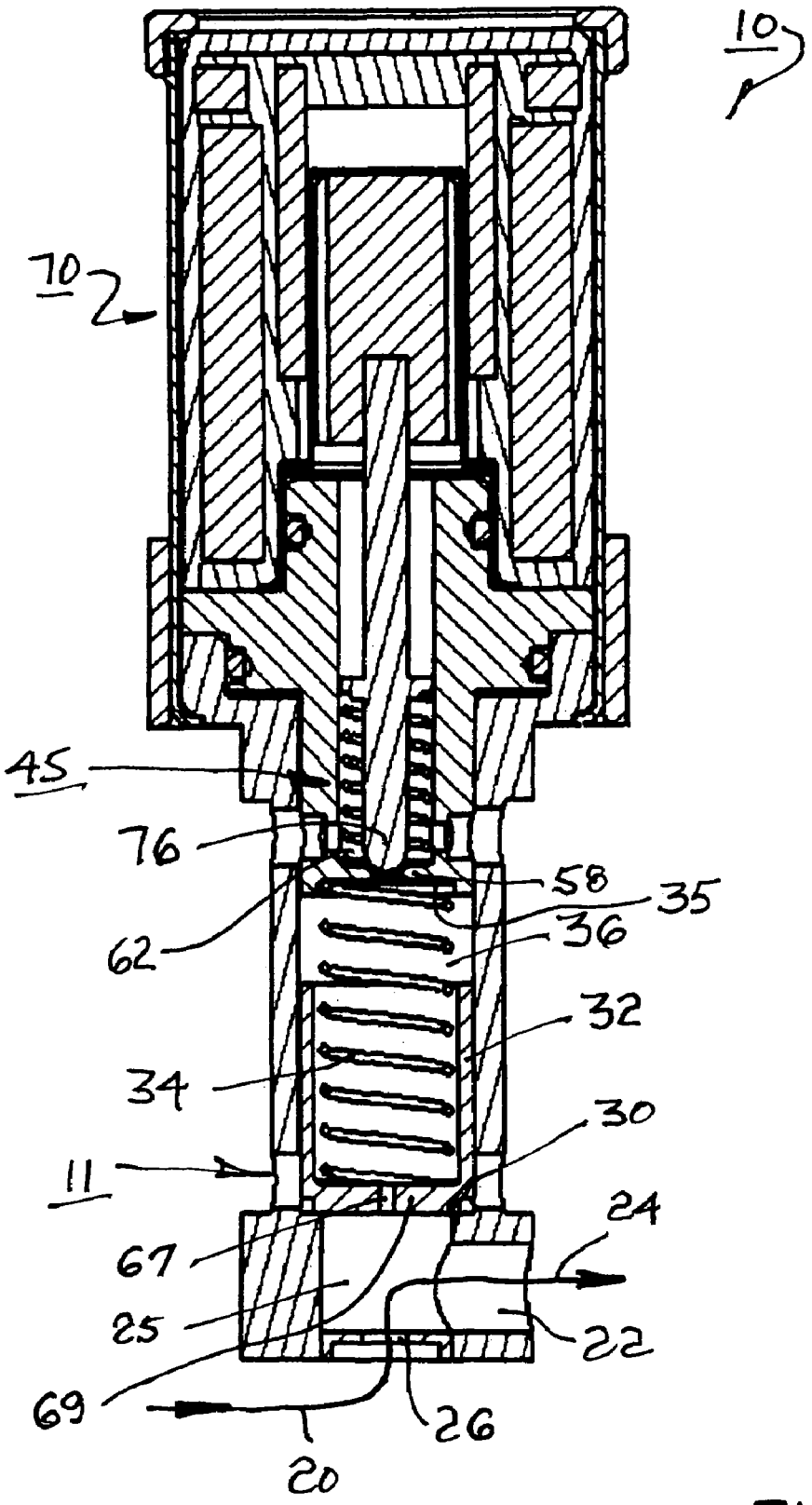
FIG. 2 is a view like that shown in FIG. 1, but showing the valve assembly in actuation mode for providing high oil flow and pressure to the engine control device.

Referring to FIG. 2 (engine 16 omitted for clarity), in order to increase oil flow and pressure in control gallery 22 when actuation of the control device is desired, the relief and excess oil flows shown in FIG. 1 must be shut off. This is accomplished by energizing solenoid actuator 70 to close second valve 45 by engaging valve head 76 with secondary valve seat 58. Closing the secondary valve seat has two hydraulic consequences. First, second chamber 36 is completely filled with trapped oil, which is incompressible; thus relief valve plunger 32 cannot be forced off of first valve seat 30 as pressure begins to rise in first chamber 25. Second, chamber 36 communicates with first chamber 25 via passage 67, and as pressure in first chamber 25 rises so does pressure in second chamber 36, balancing the hydraulic forces on plunger end 69; thus, relief spring 34 assists in keeping first valve 11 closed, allowing full engine oil pressure (minus whatever drop is dictated by orifice 26) to be applied to control gallery 22.

Thus the primary and secondary objects of the invention are realized: to controllably vary the flow of pressurized oil between a high-flow/high-pressure condition and a low flow/low-pressure condition, and to provide such control electromechanically via a simple solenoid valve.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A compound valve assembly for controlling pressure drop in oil flowing from a high pressure source through said assembly into a control gallery, comprising:

a) a primary valve disposable in said flowing oil as a relief valve to bypass a portion of said oil to provide low pressure in said oil flowing to said control gallery; and b) a controllable second valve adjacent said primary valve for allowing or preventing flow of said bypass oil to allow opening of said primary valve as desired to provide said low oil pressure in said control gallery, and to prevent said opening of said primary valve as desired to provide high oil pressure in said control gallery.

2. A valve assembly in accordance with claim 1 wherein said primary valve comprises:

a) a first valve body having first and second chambers therein separated by a first valve seat;

b) a relief plunger disposed in said second chamber for variably seating against said first valve seat;

c) a relief spring biasedly disposed in said second chamber against said plunger for preventing flow of oil across said first valve seat when oil pressure in said first chamber is insufficient to overcome said relief spring bias; and d) a passage through said relief plunger for communication between said first and second chambers.

3. A valve assembly in accordance with claim 2 wherein said second valve comprises:

a) a second valve body disposed in said second chamber and having a third chamber separated from said second chamber by a second valve seat;

b) a pintle valve head disposed in said third chamber for variably seating against said second valve seat;

c) a return spring disposed against said pintle valve head in said third chamber for urging said second valve toward an open position;

d) means for selectively closing said secondary valve; and e) a relief passage leading from said third chamber for flow of oil passing through said secondary valve.

4. A valve assembly in accordance with claim 3 wherein said means for closing includes a solenoid actuator operatively connected to said pintle valve head.

5. A valve assembly in accordance with claim 3 further including a flow path for said bypass oil from said first chamber to said relief passage, said flow path comprising:

a) an annular space around said first valve body and communicating with said relief passage; and b) a port connecting said second chamber and said relief passage.

6. A compound valve assembly disposable in an internal combustion engine for controlling pressure of oil flowing from an oil pump through an oil supply gallery into a control gallery for variably controlling actuation of an engine component, comprising:

a) a primary valve disposable in said flowing oil between said supply gallery and said control gallery to bypass a portion of said oil to an oil sump to provide low oil pressure in said control gallery; and b) a solenoid-actuable second valve adjacent said primary valve for allowing opening of said primary valve to provide said low oil pressure as desired in said control gallery, and for preventing said opening of said primary valve to provide high oil pressure as desired in said control gallery.

7. An internal combustion engine having a system for deactivation of a least one engine valve, the engine comprising a compound valve assembly for controlling pressure drop in oil flowing from a high pressure source through the valve assembly into a control gallery for deactivating said valve, the valve assembly including, a primary valve disposable in said flowing oil as a relief valve to bypass a portion of said oil to provide low pressure in said oil flowing to said control gallery, and a controllable second valve adjacent said primary valve for allowing or preventing flow of said bypass oil to allow opening of said primary valve as desired to provide said low oil pressure in said control gallery, and to prevent said opening of said primary valve as desired to provide high oil pressure in said control gallery.

* * * * *